US006841760B2

(12) United States Patent
Whipple, Jr.

(10) Patent No.: US 6,841,760 B2
(45) Date of Patent: Jan. 11, 2005

(54) MULTIPLE CURRENT SUPPLY CONTROL SYSTEM FOR A COOKING APPLIANCE

(75) Inventor: Robert Z. Whipple, Jr., Louden, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/459,486

(22) Filed: Jun. 12, 2003

(65) Prior Publication Data

US 2004/0251247 A1 Dec. 16, 2004

(51) Int. Cl.[7] ..... A21B 1/00
(52) U.S. Cl. ..... 219/395; 307/11
(58) Field of Search ..... 219/391, 392, 219/395, 398, 483, 485, 488, 490, 497; 307/10.1, 11, 31–35, 38, 40

(56) References Cited

U.S. PATENT DOCUMENTS

| | | | | |
|---|---|---|---|---|
| 2,521,171 A | | 9/1950 | Kercher | |
| 3,005,109 A | | 10/1961 | Funkhouser et al. | |
| 4,010,412 A | | 3/1977 | Forman | |
| 4,028,613 A | | 6/1977 | Stiller et al. | |
| 4,223,207 A | | 9/1980 | Chow | |
| 4,420,668 A | | 12/1983 | Larson et al. | |
| 4,499,385 A | * | 2/1985 | Slavik | 307/10.1 |
| 4,634,843 A | | 1/1987 | Payne | |
| 4,663,948 A | | 5/1987 | Rummel | |
| 4,843,202 A | | 6/1989 | Smith, et al. | |
| 4,851,635 A | | 7/1989 | Farrow | |
| 5,079,410 A | * | 1/1992 | Payne et al. | 219/506 |
| 5,191,191 A | | 3/1993 | St. Aubyn | |
| 5,293,028 A | | 3/1994 | Payne | |
| 5,310,984 A | | 5/1994 | Ratledge et al. | |
| 5,618,458 A | * | 4/1997 | Thomas | 219/394 |
| 5,774,528 A | | 6/1998 | Bogner et al. | |
| 5,844,207 A | | 12/1998 | Allard et al. | |
| 5,948,305 A | | 9/1999 | Petrides et al. | |
| 5,990,460 A | | 11/1999 | Petty et al. | |
| 6,107,610 A | | 8/2000 | Tarr | |
| 6,157,008 A | | 12/2000 | Brown et al. | |
| 6,232,582 B1 | | 5/2001 | Minnear et al. | |
| 6,388,235 B1 | | 5/2002 | Sauter et al. | |
| 6,396,169 B1 | | 5/2002 | Voegeli et al. | |
| 2002/0185916 A1 | | 12/2002 | Barton et al. | |

FOREIGN PATENT DOCUMENTS

| | | |
|---|---|---|
| JP | 406104986 A | 4/1994 |

* cited by examiner

*Primary Examiner*—Thor Campbell
(74) *Attorney, Agent, or Firm*—Diederiks & Whitelaw, PLC

(57) ABSTRACT

A cooking appliance includes an oven cavity, an electric heating system having a plurality of electric heat loads for heating the oven cavity, and a controller. The controller includes a memory module having stored therein at least first and second control algorithms for operating the electric heating system based upon an available current supply. If the cooking appliance is connected to a low current rated circuit, the controller will operate according to the first control algorithm and cycle activation of the plurality of heat loads in a manner not to overload the available current supply. Conversely, if the appliance is connected to a high current rated circuit, the control unit will operate according to the second control algorithm and enable activation of multiple heating loads simultaneously. Preferably, the appliance includes a switch or sensor for toggling between the first and second control algorithms.

23 Claims, 2 Drawing Sheets

MULTIPLE CURRENT SUPPLY CONTROL SYSTEM FOR A COOKING APPLIANCE

BACKGROUND OF THE INVENTION

1. Field of the Invention

The present invention pertains to the art of cooking appliances and, more particularly, to a cooking appliance including a control unit for varying operational parameters of the appliance based, at least in part, upon the current rating of a supply circuit.

2. Discussion of the Prior Art

A typical modern cooking appliance will include multiple electric heat loads, such as electric heating elements, convection fans and, in some cases, a microwave heating system. As a result, most modern electric cooking appliances are designed to operate on a high current rating, such as a 30 amp supply circuit. However, as older cooking appliances did not include all the modern amenities consumers now demand, they were designed to operate on a low current rating, such as a 20 amp supply circuit. Consequently, many older households are not designed to take full advantage of the many features provided in modern cooking appliances.

By design, modern appliances are programmed to operate multiple electrical loads simultaneously. For example, during a bake process, the electric heating element and the convection fan are operated. During other cooking operations, multiple heating elements are operated and, if so equipped, the microwave system can be used to perform a portion of the cooking process. Certainly, when multiple electrical loads are operated on a low current rated circuit, the circuit will overload and a breaker will trip, thereby cutting the current flow to the appliance and interrupting the cooking process.

In recognition of this problem, the prior art contains several methods of operating a cooking appliance so as to not overload the supply circuit. In one example, electrical current is delivered to a plurality of electric burners in bursts, such that the overall current draw on the circuit remains within the limitation of a circuit breaker. In other examples, each of a plurality of electrical loads is given a set order of priority and, either through use of an interlock system, a current sensor or through control programming, current is delivered to the loads in the set order of priority. While effective at preventing circuit overloads, each of the above examples have certain inherent limitations. If, for example, the low current rated circuit is upgraded to a high current rated circuit, the appliance will continue to operate the loads in the set order or priority and could not adapt to the new available current supply.

Therefore, despite the existence of prior art cooking appliances which operate to limit current draw on a circuit, there still exists a need in the art for a cooking appliance that can operate on a low current rated circuit and have the flexibility to adapt to a high current rated circuit in the future. Moreover, there exists a need in the art for an appliance that includes a control unit having stored therein multiple algorithms for operating the appliance based on the actual current rating of a supply circuit.

SUMMARY OF THE INVENTION

The present invention is directed to a cooking appliance including an oven cavity, an electric heating system having a plurality of electric heating loads for heating the oven cavity, and a controller, wherein the controller includes a memory module having stored therein at least first and second appliance control algorithms for operating the electric heating system based upon an available supply current. In accordance with one aspect of the invention, the controller operates the electric heating system according to the first control algorithm when the appliance is connected to a low current rated circuit and, upon connection to a high current rated circuit, according to the second control algorithm. When operating according to the first control algorithm the controller activates the plurality of electrical loads in a manner that prevents circuit overload. Conversely, when operating according to the second control algorithm, the controller activates one or more of the plurality of electrical loads so as to more efficiently perform the cooking process.

In accordance with the most preferred form of the invention, the cooking appliance includes a switch interconnected with the controller for toggling between the first and second control algorithms. In one preferred form, the switch is interconnected with a display screen that provides a user with a set-up menu for establishing initial settings for the appliance. In other forms, the switch is constituted by a jumper wire, a bus circuit and a manual cut wire arrangement, an automatic line sensor, or the like. In any event, the switch enables the appliance to either manually or automatically toggle between the first and second control algorithms depending upon the available current supply.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENTS

Figure 1:
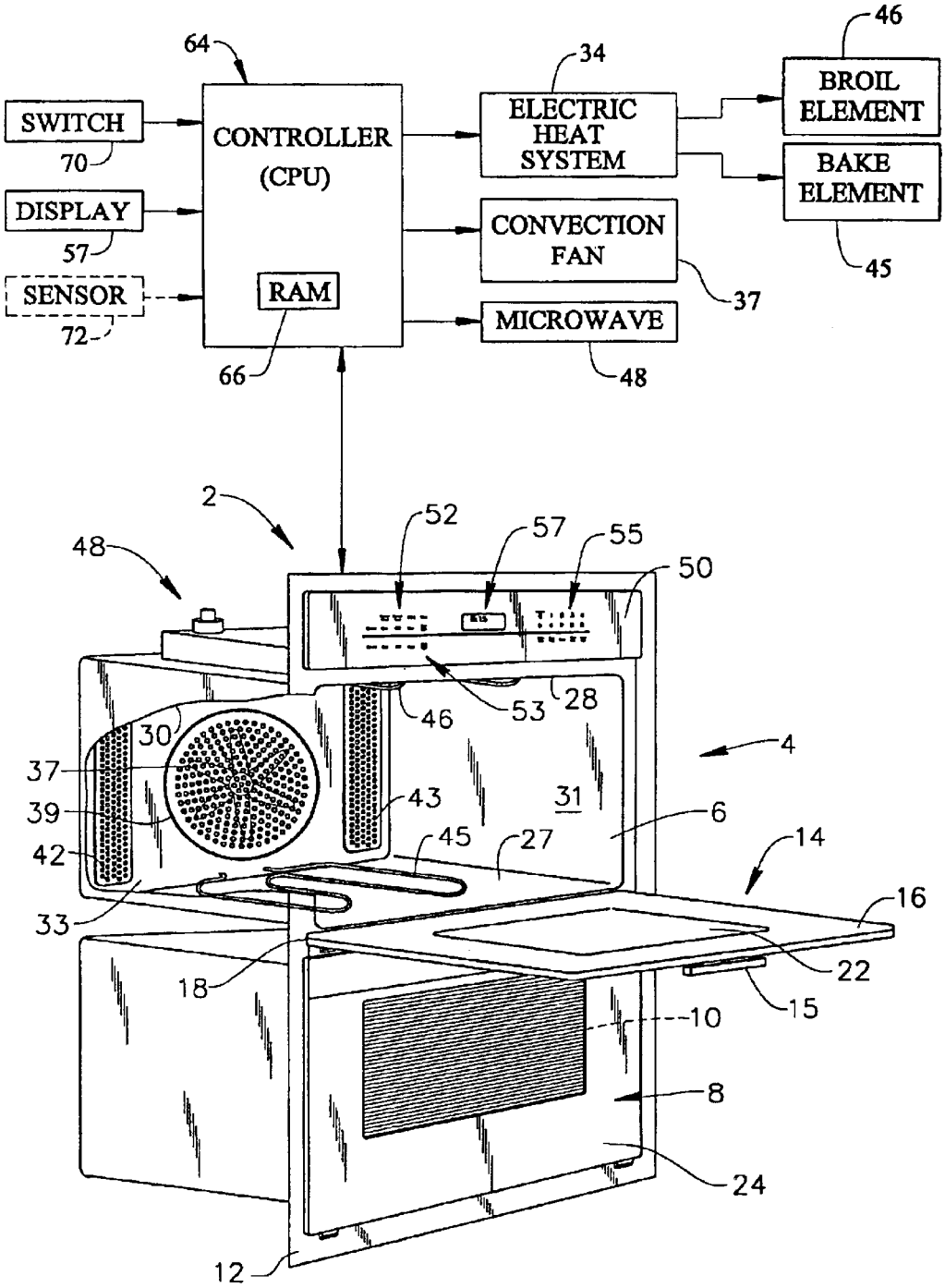
FIG. 1 is a partial perspective view of a wall oven including a multiple current supply control system constructed in accordance with the present invention.

With initial reference to FIG. 1, a cooking appliance incorporating a multiple current supply control system constructed in accordance with the present invention is generally shown at 2 Although the actual cooking appliance into which the control system can be incorporated may vary, the invention is shown in connection with cooking appliance 2 in the form of a wall oven. However, it should be understood that the present invention is not limited to this model type and can be incorporated into various other types of oven configurations, e.g., cabinet mounted ovens, as well as both free-standing and slide-in ranges. In the embodiment shown, cooking appliance 2 constitutes a dual oven wall unit which includes an upper oven 4 having upper oven cavity 6 and a lower oven 8 having a lower oven cavity 10. Cooking appliance 2 includes an outer frame 12 for at least partially supporting both upper oven cavity 6 and lower oven cavity 10 within a wall (not shown).

In a manner known in the art, a door assembly 14 is included to selectively provide access to upper oven 4. As shown, door assembly 14 is provided with a handle 15 at an upper portion 16 thereof. In the embodiment illustrated, door assembly 14 is adapted to pivot at a lower portion 18 to enable selective access to oven cavity 6. In a manner also known in the art, door 14 is provided with a transparent zone 22 for viewing the contents of oven cavity 6 when door 14 is closed. In a similar arrangement, lower oven 8 includes a respective door assembly 24.

As clearly shown in FIG. 1, oven cavity 6 is preferably defined by a smooth bottom wall 27, an upper wall 28, opposing side walls 30–31 and rear wall 33. Bottom wall 27 is provided as a smooth flat surface in order to improve cleanability and to also improve the reflective qualities of oven cavity 6. In accordance with a preferred embodiment, cooking appliance 2 preferably employs both radiant and convection heating techniques. To this end, cooking appliance 2 includes an electric heat system 34, as well as additional electrical loads, such as, for example, a convection fan 37 having a perforated cover 39 adapted to withdraw heated air from oven cavity 6. The heated air is thereafter returned to oven cavity 6 through a pair of outlet vents 42 and 43 arranged on either side of rear wall 33. Electric heating system 34 includes a plurality of heating elements which, in the embodiment shown, take the form of a lower bake element 45 and a top broiler element 46 positioned on bottom and upper walls 27 and 28 respectively. Top broiler element 46 is provided to enable a consumer to perform a grilling process in upper oven 4 and to aid in pyrolytic heating during a self-clean operation. More specifically, both bake element 45 and top broiler element 46 are preferably constituted by sheathed electric resistive heating elements. Finally, as shown in the embodiment illustrated, electric heating system 34 includes an electrical load in the form of a microwave cooking system indicated generally at 48.

Cooking appliance 2 also incorporates an upper control panel 50. In the embodiment shown, control panel 50 includes first and second rows of oven control buttons 52 and 53 for programming, in combination with a numeric pad 55 and a display 57, particular cooking operations for upper and lower ovens 4 and 8 respectively. Since the general programming and operation of cooking appliance 2 is known in the art and does not form part of the present invention, these features will not be discussed further here. Actually, the structure described above with respect to cooking appliance 2 is already known in the art and does not constitute part of the present invention. Therefore, this structure has only been described for the sake of completeness. Instead, the present invention is particularly directed to a multiple current supply control system for establishing operational parameters of cooking appliance 2 based upon an available supply current.

As shown schematically in FIG. 1, cooking appliance 2 includes a controller 64 interconnected with control panel 50 and the plurality of electrical loads. More specifically, controller 64 includes a memory module 66 having stored therein at least first and second control algorithms. As will be discussed more fully below, controller 64 selectively operates the electrical loads according to a select one of the first and second control algorithms depending upon an available supply current.

In accordance with one preferred form of the invention, cooking appliance 2 includes a switch 70 provided to enable a user to toggle between a connection to either a low current rated circuit or a high current rated circuit. Preferably, switch 70 is interconnected with controller 64 and display 57. More specifically, display 57 includes a set-up menu for allowing the user to input initial settings for cooking appliance 2 through manipulation of control elements 52, 53 and numeric pad 55. With this arrangement, the user can input into controller 64 the presence of a connection to either a low or high current rated circuit. With this information, controller 64 will operate the electrical loads in accordance with the appropriate one of the first and second control algorithms. At this point it should be understood that various other types of switches can be employed to select the appropriate supply current input. For example, switch 70 may take the form of a conventional selector switch, e.g., a slidable switch, or, alternatively, may be defined by a jumper wire, a cut wire connected in a bus circuit, or the like.

Figure 2:
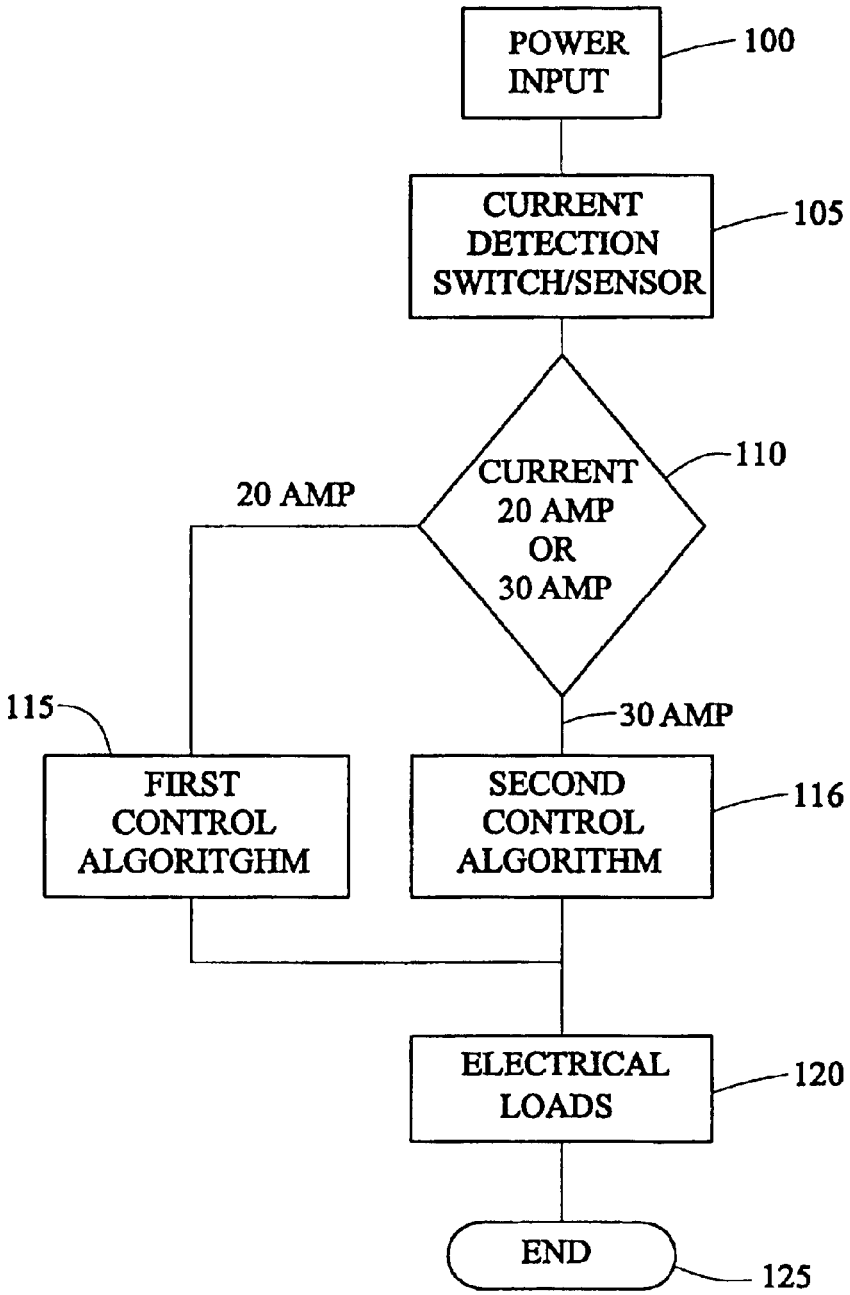
FIG. 2 is a flow-chart depicting the steps of operating the multiple current supply rate control system in accordance with the present invention.

In accordance with another preferred embodiment, a senor 72 is provided to sense the current rating of the supply circuit connected to cooking appliance 2. With sensor 72 replacing switch 70, controller 64 will automatically select between operating the electrical loads in accordance with the first and second control algorithms based upon the level of the available supply current. Having described the particular structure of the present invention, reference will now be made to FIG. 2 setting forth a preferred method of operation of the multiple current supply system of the present invention.

During an initial installation of cooking appliance 2, a connection to an electrical supply or power input is established at step 100. The electrical supply typically takes the form of a branch circuit protected by a circuit breaker (not shown) sized in conformity with requisite regulations, such as the National Electrical Code (NEC), for protecting the particular conductor used in the branch circuit. In most new households, the branch circuit is protected by a 30 amp circuit breaker. However, older homes may be limited to a 20 amp or less current supply. Therefore, in order to not overload the supply circuit, the current rating of the circuit must be established as an input to cooking appliance 2 at step 105. In accordance with one form of the invention, the current rating is input through switch 70. Alternatively, the current rating is detected by sensor 72 connected to the power input.

Once the current rating is input in step 105, in step 110, controller 64 determines whether the current input is a low rated current supply, e.g. 20 amps, or a high rated current supply, e.g. 30 amps. If it is determined that the power supply provides a low rated current supply, controller 64 employs first control algorithm in step 115. In accordance with the first control algorithm, controller 64 operates the electrical loads, i.e. convection fan 37, bake and broil elements 45 and 46 and, if so equipped, microwave system 48 interdependently such that, in step 120, the electrical loads are activated in a manner such that cooking appliance 2 will proceed through a cooking operation without exceeding the current rating of the supply circuit. If, however, in step 110 it is determined that cooking appliance 2 is connected to a high rated current supply, controller 64 employs the second control algorithm in step 116.

When operating in accordance with the second control algorithm, controller 64 will activate multiple ones of the plurality of the electrical loads in step 120. In this manner, convection fan 37 can operate in combination with either bake element 45, broil element 46, both bake element 45 and broil element 46, or, if so equipped, any of the loads could be operated in combination with microwave system 48. At this point, it should be noted that the various combinations of operating the electrical loads is wide ranging and is not limited to the examples set forth above. In any event, the cooking appliance 2 will operate according to the established control algorithm until reset. That is, once the first or second control algorithm is set, either through manual or automatic selection, cooking appliance 2 will continue to so operate until a change is performed manually, or in the case of automatic operation, until power is interrupted causing sensor 72 to re-detect the current rating. Once the cooking operation has completed, as determined either through a manual input or through an associated timer, controller 64 terminates operation of the heating system at step 125.

Although described with reference to a preferred embodiment of the present invention, it should be readily apparent of one of ordinary skill in the art that various changes and/or modifications can be made to the invention without departing from the spirit thereof. For instance, although only two control algorithm options have been discussed, additional algorithms could be pre-stored in controller 64 depending on the potential for even further current supplies. In general, the invention is only intended to be limited to the scope of the following claims.

I claim:

1. A cooking appliance comprising:

an oven cavity including top, bottom, rear and opposing side walls;

an electric heating system including a plurality of electric heating loads for heating the oven cavity for a cooking process; and a controller including a memory module having stored therein at least first and second appliance control algorithms for operating the electric heating system based upon an available circuit current rating wherein, upon connection to a low current rated circuit, the controller operates according to the first control algorithm and, upon connection to a high current rated circuit, the controller operates the appliance according to the second control algorithm.

2. The cooking appliance according to claim 1, wherein the first control algorithm cycles operation of the plurality of electric heating loads so as not to exceed a rating of the low current rated circuit, and the second control algorithm operates a plurality of the electric heating loads simultaneously.

3. The cooking appliance according to claim 2, further comprising: a display unit for providing appliance operation information to a user, said operational information including an initial set-up menu for inputting initial settings for the cooking appliance.

4. The cooking appliance according to claim 3, further comprising: a switch adapted to toggle between the first and second control algorithms for input to the set-up menu.

5. The cooking appliance according to claim 2, further comprising:

switch means for toggling between the first and second control algorithm.

6. The cooking appliance according to claim 2, further comprising: a current sensor for detecting the available circuit current rating.

7. The cooking appliance according to claim 6, wherein the controller automatically switches between the first and second control algorithm based upon a signal received from the current sensor.

8. The cooking appliance according to claim 2, wherein the low current rated circuit is 20 amps and the high current rated circuit is 30 amps.

9. The cooking appliance according to claim 1, wherein the plurality of electric heating loads includes a sheathed, electric resistive heating element and a convection fan.

10. The cooking appliance according to claim 9, wherein the plurality of electric heating loads includes a microwave cooking system.

11. A cooking appliance comprising:

an oven cavity including top, bottom, rear and opposing side walls;

an electric heating system including a plurality of electric heating loads for heating the oven cavity for a cooking process; and a switch for changing between operating the appliance according to first or second control algorithms, wherein operation under the first control algorithm causes cycling of the plurality of electric heating loads so as not to exceed a current rating of a circuit to which the appliance is connected, and operating under the second control algorithm enables the plurality of electrical heating loads to be operated simultaneously.

12. The cooking appliance according to claim 11, wherein the first control algorithm is associated with a low current rated circuit and the second control algorithm is associated with a high current rated circuit.

13. The cooking appliance according to claim 12, wherein the low current rated circuit constitutes a 20 amp circuit and the high current rated circuit constitutes a 30 amp circuit.

14. The cooking appliance according to claim 11, further comprising:

a display unit for providing appliance operation information to a user, said operational information including an initial set-up menu for inputting initial settings for the cooking appliance.

15. The cooking appliance according to claim 14, further comprising:

a switch adapted to toggle between the first and second control algorithms for input to the set-up menu.

16. The cooking appliance according to claim 11, further comprising:

a current sensor for detecting the current rating of the circuit to which the appliance is connected.

17. The cooking appliance according to claim 16, wherein the controller automatically switches between the first and second control algorithm based upon a signal received from the current sensor.

18. The cooking appliance according to claim 11, the plurality of electric heating loads includes a sheathed, electric resistive heating element and a convection fan.

19. The cooking appliance according to claim 18, wherein the plurality of electric heating loads includes a microwave cooking system.

20. A method of operating a cooking appliance including a electric heating system having a plurality of electric heating loads and a controller including a memory module having stored therein at least first and second control algorithms comprising:

establishing a connection between the appliance and either a low current rated circuit or a high current rated circuit;

indicating a presence of either the low current rated circuit or the high current rated circuit to the controller;

operating the electric heating system according to the first control algorithm if the low current rated circuit is indicated wherein less than all of the plurality of electric heat loads are permitted to be operated at a given time; and operating the electric heating system according to the second control algorithm if the high current rated circuit is indicated wherein all of the plurality of electric heat loads are permitted to be operated at a given time.

21. The method of claim 20, further comprising:

activating a display screen;

initiating a set-up menu on the display screen; and inputting into the set-up menu the connection to the low current-rated circuit or the high current rated circuit.

22. The method of claim 20, further comprising:

manually selecting the presence of either the low current rated circuit or the high current rated circuit.

23. The method of claim 20, further comprising:

sensing the connection between the appliance and either the low current rated circuit or the high current rated circuit; and automatically operating the electric heating system according to the first or second control algorithms.

* * * * *